US008474811B2

(12) United States Patent
Takahashi et al.

(10) Patent No.: US 8,474,811 B2
(45) Date of Patent: Jul. 2, 2013

(54) SHEET FEEDING DEVICE AND IMAGE FORMING APPARATUS INCORPORATING SAME

(75) Inventors: Toshiaki Takahashi, Tokyo (JP); Yoshikuni Ishikawa, Tokyo (JP); Yu Wakabayashi, Kanagawa-ken (JP); Manabu Nonaka, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/443,295

(22) Filed: Apr. 10, 2012

(65) Prior Publication Data

US 2012/0193861 A1 Aug. 2, 2012

Related U.S. Application Data

(63) Continuation of application No. 12/926,515, filed on Nov. 23, 2010.

(30) Foreign Application Priority Data

Nov. 27, 2009 (JP) ..... 2009-269845

(51) Int. Cl.
*B65H 3/16* (2006.01)

(52) U.S. Cl.
USPC ..... 271/18.1; 271/34

(58) Field of Classification Search
USPC ..... 271/18.1, 34, 275
See application file for complete search history.

(56) References Cited

U.S. PATENT DOCUMENTS

| | | | |
|---|---|---|---|
| 4,353,541 | A | 10/1982 | Parzygnat |
| 4,634,111 | A | 1/1987 | Werner |
| 5,316,282 | A | 5/1994 | Fukube et al. |
| 5,320,339 | A | 6/1994 | Thomas et al. |
| 5,322,269 | A | 6/1994 | Fukube et al. |
| 5,934,662 | A | 8/1999 | Acquaviva |
| 6,332,612 | B1 | 12/2001 | Kanemura |
| 6,938,894 | B2 | 9/2005 | Miller et al. |
| 7,828,280 | B2 | 11/2010 | Kim et al. |
| 2002/0005611 | A1 | 1/2002 | Kojima et al. |
| 2006/0233578 | A1 | 10/2006 | Maki et al. |

FOREIGN PATENT DOCUMENTS

| | | |
|---|---|---|
| JP | 05139548 | 6/1993 |
| JP | 05270677 | 10/1993 |
| JP | 09-067033 | 3/1997 |
| JP | 3159727 | 2/2001 |
| JP | 2009/023813 | 2/2009 |

OTHER PUBLICATIONS

Abstract of JP 04-251041 published on Sep. 7, 1992.

*Primary Examiner* — Kaitlin Joerger
(74) *Attorney, Agent, or Firm* — Harness, Dickey & Pierce P.L.C.

(57) ABSTRACT

A sheet feeding device includes a sheet carrying unit, an attraction separation device electrostatically attracting and separating an uppermost sheet from a sheet stack and including multiple rollers, an endless dielectric belt stretched over the multiple rollers, and an elastic member provided inside a loop of the belt to cause the endless dielectric belt to contact the uppermost sheet, a sheet conveying device, and a lifting and lowering device. The lifting and lowering device lifts the sheet stack to a lift position at which the uppermost sheet contacts with the attraction separation device, and the attraction separation device stands by for a predetermined time to attract the uppermost sheet and starts to convey the uppermost sheet after the predetermined time elapses in a state in which the sheet stack remains at the lift position.

5 Claims, 4 Drawing Sheets

SHEET FEEDING DEVICE AND IMAGE FORMING APPARATUS INCORPORATING SAME

CROSS-REFERENCE TO RELATED APPLICATIONS

This application is a Continuation of U.S. application Ser. No. 12/926,515 filed Nov. 23, 2010, which claims priority pursuant to 35 U.S.C. §119 from Japanese Patent Application No. 2009-269845, filed on Nov. 27, 2009 in the Japan Patent Office, which is hereby incorporated by reference herein in its entirety.

BACKGROUND

1. Field of the Invention

Example embodiments relate to a sheet feeding device that separates and conveys the uppermost sheet from a sheet stack using electrostatic attraction method, and an image forming apparatus including the sheet feeding device.

2. Discussion of the Related Art

Background sheet feeding devices that separate and convey the uppermost sheet from a sheet stack include those that separate and feed stacked sheets, such as documents and recording sheets, by using frictional force, those that separate and feed sheets by air suction.

In background sheet feeding devices using the frictional separation method, which separates sheets by using frictional force, a material such as rubber is used to form feeding rollers. Therefore, a change over time in the condition of the feeding rollers due to abrasion or the like results in a change in the frictional force exerted by the feeding rollers, that is, consequent deterioration of feeding performance. Further, when separating and feeding sheets having unequal coefficients of friction due to variations from sheet to sheet, or when separating and feeding sheets having inherently different coefficients of friction in the same feeding operation, the frictional force acting between the feeding rollers and the sheets changes. In some cases, therefore, the separation of sheets fails, or multiple feeding occurs in which a plurality of sheets are fed together. Further, the feeding rollers need to be pressed against the sheets in order to function and in some cases the sheets are dirtied or damaged as a result.

By contrast, background sheet feeding devices using the air suction method, which separates sheets by air suction, employ a non-frictional separation method not relying on the frictional force acting between the feeding rollers and the sheets, and thus the above-described problems do not arise. However, the sheet feeding device requires a blower and a duct for the air suction. As a result, the sheet feeding device is increased in size, and the sound accompanying the air suction constitutes noise. Therefore, this type of sheet feeding device is not suitable for use in an office environment.

In view of the above, as one non-frictional separation methods, an electrostatic attraction separation method has been proposed which generates an electric field in a dielectric belt and brings the dielectric belt into contact with a sheet to attract and separate the sheet from other sheets.

Specifically, a background sheet feeding device according to the electrostatic attraction separation method first applies an alternating charge to an endless dielectric belt wound around a plurality of rollers, and swings or translates the dielectric belt relative to a sheet stack such that the dielectric belt approaches or contacts the sheet stack. Then, the sheet feeding device causes the dielectric belt to stand by for a predetermined time to attract the uppermost sheet of the sheet stack, and thereafter moves the dielectric belt away from the sheet stack, thereby, separating the uppermost sheet and conveying it from the sheet stack.

The sheet feeding device using the electrostatic attraction separation method is advantageous in preventing not only the abrasion of the feeding rollers and the damage to the sheets, which occur in the frictional separation method, but also the increase in device size and the noise generation, which occur in the air suction method.

When separating and feeding relatively thick sheets or sheets difficult to attract due to the electrical characteristics thereof, however, sheet feeding devices using the electrostatic attraction separation method need to extend the predetermined time for causing the dielectric belt to stand by to have the attraction force thereof act on the uppermost sheet. As a result, the productivity suffers.

SUMMARY

Example embodiments disclose a novel sheet feeding device. In one example embodiment, a sheet feeding device includes a sheet carrying unit, an attraction separation device, a sheet conveying device, and a lifting and lowering device. The sheet carrying unit is configured to carry thereon a sheet stack. The attraction separation device is configured to electrostatically attract the uppermost sheet of the sheet stack and separate the uppermost sheet from the sheet stack. Further, the attraction separation device includes a plurality of rollers, an endless belt formed by a dielectric material and stretched over the plurality of rollers, and an elastic member provided inside the belt and configured to bring the belt into contact with the uppermost sheet. The sheet conveying device is configured to convey the uppermost sheet separated by the attraction separation device. The lifting and lowering device is configured to lift and lower the sheet stack carried on the sheet conveying device. The sheet feeding device causes the lifting and lowering device to lift the sheet stack to a lift position at which the uppermost sheet comes into contact with the attraction separation device, causes the attraction separation device to stand by for a predetermined time to attract the uppermost sheet, and causes the attraction separation device to start, after the lapse of the predetermined time, conveying the uppermost sheet with the sheet stack kept at the lift position.

Example embodiments further disclose a novel image forming apparatus. In one example embodiment, an image forming apparatus includes the above-described sheet feeding device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF EXAMPLE EMBODIMENTS

Figure 1:
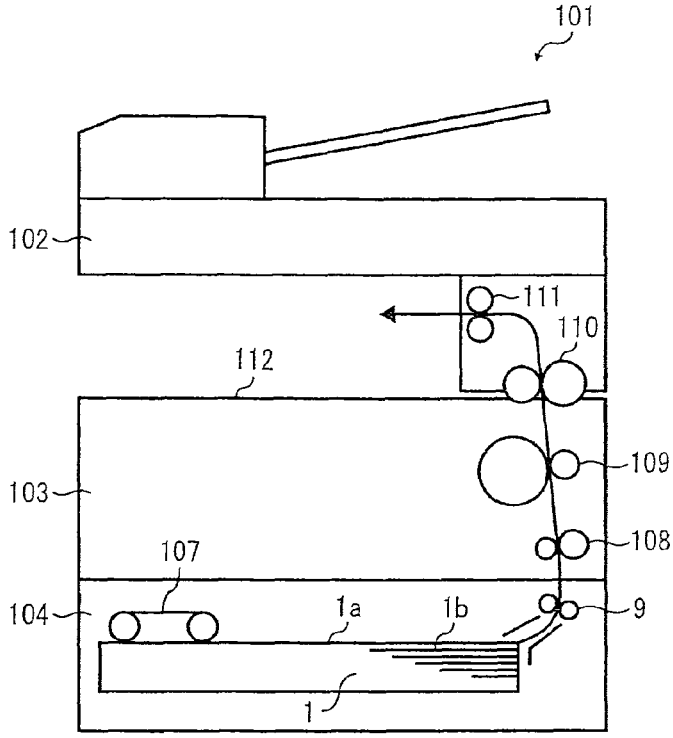
FIG. 1 is a schematic cross-sectional view of an embodiment of an image forming apparatus including a sheet feeding device according to an embodiment of the present invention.

In describing the example embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, example embodiments of the present invention will be described.

The configuration of an example embodiment of the present invention will be first described. As illustrated in FIG. 1, an image forming apparatus 101 is configured as an electrophotographic digital copier, and includes a document reading unit 102, an image forming unit 103, and a sheet feeding device 104. The document reading unit 102 reads the image of a document. The sheet feeding device 104, which includes a separation unit 107 and a sheet feeding roller pair 9, feeds a recording sheet (i.e., recording medium, hereinafter simply referred to as sheet) 1*a* from a sheet stack 1, which includes the sheet 1*a*, a sheet 1*b* and other sheets, to the image forming unit 103. The image forming unit 103 forms the image read by the document reading unit 102 on the sheet 1*a* fed from the sheet feeding device 104. In the image forming apparatus 101 according to the present embodiment, the image forming unit 103 and the sheet feeding device 104 can be separated from each other.

The sheet 1*a* fed by the sheet feeding device 104 is conveyed by a conveying roller pair 108. Then, a toner image formed by the image forming unit 103 is transferred onto the sheet 1*a* by a transfer device 109 and thermally transferred and fixed to the sheet 1*a* by a fixing device 110. Thereafter, the sheet 1*a* is discharged onto a sheet discharging tray 112 by a sheet discharging roller pair 111.

The image forming method employed by the image forming apparatus 101 is not limited to the electrophotographic method. Thus, the image forming apparatus 101 may employ another method, such as the inkjet method, for example. Further, the image forming apparatus 101 is not limited to the copier, and thus may be configured as a facsimile machine, a printer, a multifunctional machine, and so forth.

Figure 2:
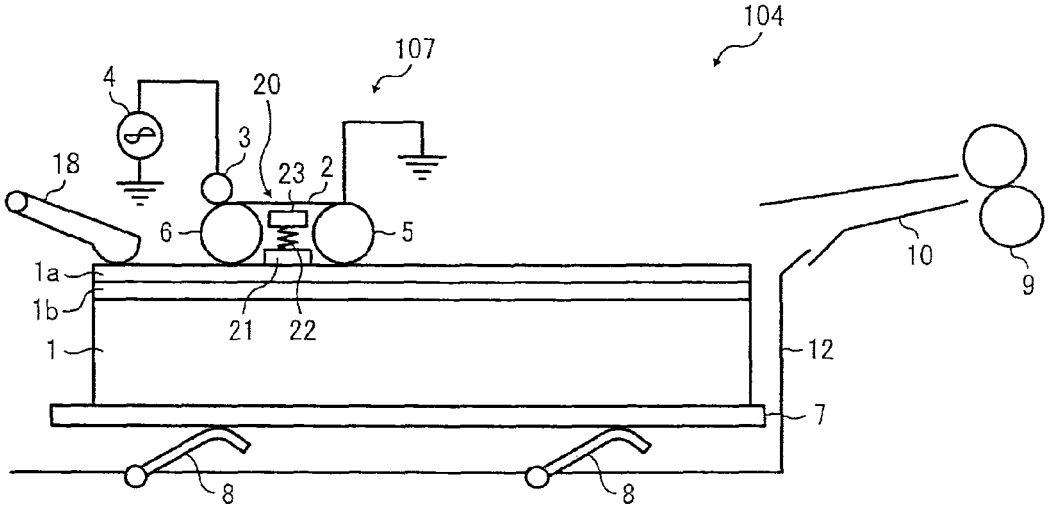
FIG. 2 is a cross-sectional view illustrating the sheet feeding device according to the embodiment of the present invention.
Figure 3:
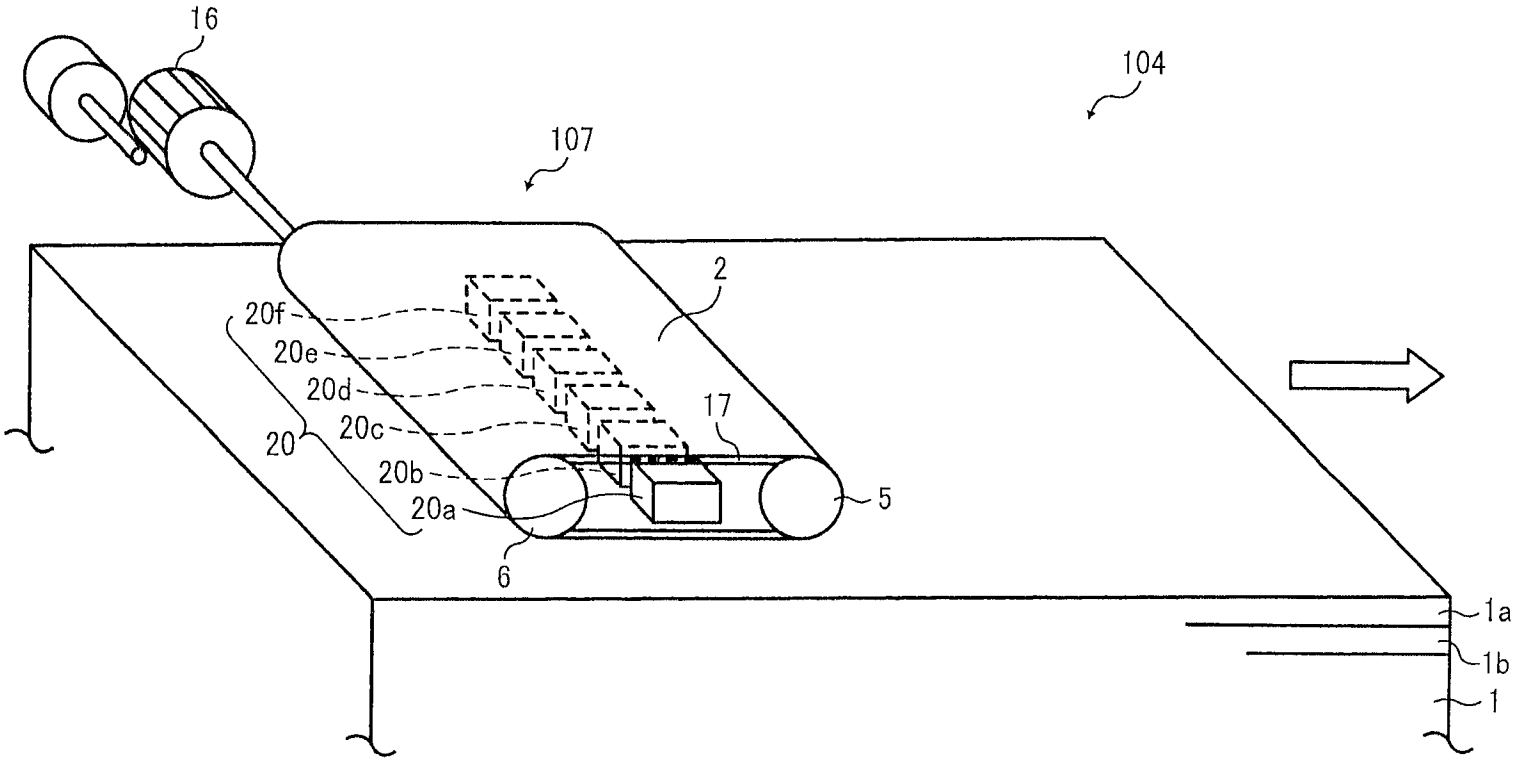
FIG. 3 is a perspective view illustrating the sheet feeding device according to the embodiment of the present invention.

As illustrated in FIGS. 2 and 3, the sheet feeding device 104 includes a sheet feeding tray 12 for storing the sheet stack 1, a bottom plate 7 that serves as a sheet carrying unit and is provided under a bottom portion of the sheet feeding tray 12 to carry thereon the sheet stack 1, bottom plate lifting arms 8 for lifting and lowering the bottom plate 7, and the separation unit 107 which comes into contact with the upper surface of the sheet stack 1, electrostatically attracts and separates the uppermost sheet 1*a* from the sheet stack 1, and conveys the separated sheet 1*a*.

The separation unit 107 includes a downstream roller 5, an upstream roller 6, and an endless belt 2 formed by a dielectric material and wound around the downstream roller 5 and the upstream roller 6.

The upstream roller 6 is configured as a drive roller which receives drive force from a not-illustrated drive source. The downstream roller 5 is configured as a driven roller which is driven to rotate in accordance with the rotation of the upstream roller 6 via the belt 2. The drive force from the not-illustrated drive source is transmitted to the upstream roller 6 via an electromagnetic clutch 16. The electromagnetic clutch 16 is activated in accordance with a sheet feeding signal to intermittently drive the upstream roller 6.

A surface of the upstream roller 6 is formed by a conductive rubber layer having a resistance value of approximately $10^6$ Ω·cm (ohm centimeters). Meanwhile, a surface of the downstream roller 5 is made of metal. The upstream roller 6 and the downstream roller 5 are electrically grounded. The downstream roller 5 has a relatively small diameter suitable for separating the sheet 1*a* from the belt 2 in accordance with the curvature thereof. That is, the downstream roller 5 is set to have a relatively small diameter to increase the curvature thereof. With this configuration, the sheet 1*a* attracted, separated, and conveyed by the belt 2 is allowed to separate from the downstream roller 5 and enter between a guide plate pair 10 located downstream in the sheet conveying direction.

The downstream roller 5 and the upstream roller 6, which respectively serve as the driven roller and the drive roller, are arranged such that a lower tangent line of the belt 2 formed by the downstream roller 5 and the upstream roller 6 is on a level with the upper surface of the sheet 1*a*.

As illustrated in FIGS. 2 and 3, an elastic member 20 is provided inside the belt 2. The elastic member 20 comes into contact with the belt 2 to press the belt 2 onto the sheet 1*a*. Thereby, the contact between the surface of the belt 2 and the sheet 1*a* is maintained.

That is, the elastic member 20 provides elasticity to the contact surface of the belt 2 such that the belt 2 comes into elastic contact with the sheet 1*a*. Therefore, even if the surface of the sheet 1*a* has irregularities, has a bump caused by multiple feeding thereof, or has a curled or undulated portion due to a phenomenon such as moisture attraction, it is possible to secure the area of contact between the belt 2 and the sheet 1*a*, and thus to ensure the attraction force for attracting the sheet 1*a* toward the belt 2, irrespective of the characteristics of the sheet 1*a*.

As illustrated in FIGS. 2 and 3, the elastic member 20 includes elastic member pieces 20*a* to 20*f*, each of which is formed by a contact member 21 which comes into contact with the inside surface of the belt 2, and a spring 22 which biases the contact member 21 toward the belt 2. One end of the spring 22 is connected to the contact member 21, and the other end of the spring 22 is connected to a holding member 23 provided to a not-illustrated casing of the sheet feeding device 104.

With each of the elastic member pieces 20*a* to 20*f* formed by the contact member 21 and the spring 22, it is possible to easily change the elastic force by changing the spring 22, irrespective of the physical properties of the material forming the contact member 21 which comes into contact with the belt 2. Accordingly, the elastic force changes for each of the elastic member pieces 20*a* to 20*f*. Therefore, even if the state of the surface of the sheet 1*a* substantially changes due to irregularities or undulations thereof, it is possible to secure the area of contact between the belt 2 and the sheet 1*a*, and thus to ensure the attraction force for attracting the sheet 1*a* toward the belt 2.

As illustrated in FIG. 3, in a direction perpendicular to the sheet conveying direction, i.e., in the width direction of the belt 2 and the sheet 1*a*, the elastic member 20 is divided into the plurality of elastic member pieces 20*a* to 20*f* each including the contact member 21 and the spring 22.

With this configuration, the plurality of elastic member pieces 20*a* to 20*f* forming the elastic member 20 are capable of expanding and contracting independently of one another in accordance with respective elastic forces. With the elastic member pieces 20*a* to 20*f* having different amounts of expansion and contraction, therefore, even if the state of the surface of the sheet 1*a* substantially changes due to irregularities or undulations thereof, it is possible to secure the area of contact between the surface of the belt 2 and the sheet 1*a*, and thus to ensure the attraction force for attracting the sheet 1*a* toward the belt 2.

Further, the elastic member 20 is divided in a direction perpendicular to the conveying direction of the sheet 1*a*. Therefore, there is no change in elastic force in the conveying direction of the sheet 1*a* and thus no burden on the sheet conveying operation. Further, even if the sheet 1*a* is undulated or curled in the direction perpendicular to the sheet conveying direction, the divided elastic member 20 brings the belt 2 into contact with the sheet 1*a*. Accordingly, it is possible to secure the area of contact between the surface of the belt 2 and the sheet 1*a*, and thus to ensure the attraction force for attracting the sheet 1*a* toward the belt 2.

The belt 2 is formed by a dielectric material having a resistance of at least approximately $10^8$ Ω·cm. The dielectric material forming the belt 2 may include, for example, a film made of polyethylene terephthalate or the like having a thickness of approximately 100 μm (micrometers).

The belt 2 is stretched over the downstream roller 5 and the upstream roller 6, slacking downward to a degree not causing the upstream roller 6 to spin around without rotating the belt 2. With the downward slacking belt 2 brought into contact with the sheet 1*a*, it is possible to secure the area of contact of the belt 2 with the sheet 1*a*, even if the sheet 1*a* is undulated.

In the present embodiment, the belt 2 is stretched over two rollers of the downstream roller 5 and the upstream roller 6. The belt 2, however, may be stretched over a larger number of rollers, and one of the rollers located most upstream in the sheet conveying direction may be configured as a drive roller.

The belt 2 is placed between the rear end position and the central position in the sheet conveying direction of the sheet stack 1 located at a sheet carrying position and having the minimum sheet size compatible with the sheet feeding device 104. For example, if the size of the sheet 1*a* compatible with the sheet feeding device 104 ranges from A5 to A3, the belt 2 is arranged such that the leading end of the belt 2, which corresponds to the position of contact of the downstream roller 5 with the sheet 1*a*, is located between the center of the length in the sheet conveying direction of the sheet 1*a* having the minimum sheet size A5 (i.e., 210 mm) and the rear end position of the sheet 1*a*, i.e., between a position apart from the leading end of the sheet 1*a* by 105 mm to a position apart from the leading end by 210 mm.

Further, the belt 2 is placed at the center in a direction perpendicular to the sheet conveying direction. That is, as for the width direction perpendicular to the sheet conveying direction, i.e., the depth direction in FIG. 1, the belt 2 is placed relative to the sheet stack 1 such that the central position of the sheet stack 1 set on the center baseline corresponds to the central position of the belt 2. The width of the belt 2 is set to a length obtained by reducing approximately 20 mm from both sides of the width of the sheet 1*a* having the maximum sheet size compatible with the sheet feeding device 104.

The guide plate pair 10 for guiding the conveyance of the sheet 1*a* and the sheet feeding roller pair 9 for conveying the sheet 1*a* entered between the guide plate pair 10 are provided downstream in the sheet conveying direction of the belt 2.

Inside portions of side edges of the belt 2 are provided with ribs 17. The ribs 17 of the belt 2 engage with respective side surfaces of the downstream roller 5 and the upstream roller 6. With this configuration, the belt 2 is prevented from moving in the width direction thereof and coming off the downstream roller 5 and the upstream roller 6.

On the upstream side in the sheet conveying direction of the separation unit 107, a feeler sensor 18 is provided which detects that the uppermost sheet 1*a* of the sheet stack 1 lifted by the bottom plate lifting arms 8 is located at a sheet feed position at which the sheet 1*a* comes into contact with the belt 2. The feeler sensor 18 is placed at a position corresponding to an end portion in the width direction of the sheet stack 1, and thus does not come into contact with the belt 2 placed on the upstream side in the sheet conveying direction.

At a position at which the belt 2 is wound around the upstream roller 6, a charging roller electrode 3 is provided which comes into contact with the outer circumferential surface of the belt 2 and is driven to rotate in accordance with the rotation of the belt 2. The roller electrode 3 is connected to an alternating-current power supply 4.

At a position upstream of the roller electrode 3 in the rotation direction of the belt 2 and downstream of the position at which the sheet stack 1 and the belt 2 separate from each other, a discharging roller electrode connected to a not-illustrated discharging power supply, which is an alternating power supply, may be provided such that the discharging roller electrode comes into contact with the belt 2 and is driven to rotate in accordance with the rotation of the belt 2. In this case, the charging roller electrode 3 and the discharging roller electrode are controlled such that the attraction force of the belt 2 has been removed by the time the leading end of the sheet 1*a* comes into contact with the sheet feeding roller pair 9. The discharging roller electrode is not necessarily required, and thus may be omitted. In the description of the present embodiment, therefore, the sheet feeding device 104 is assumed to include the charging roller electrode 3 but not to include the discharging roller electrode.

Figure 4A:
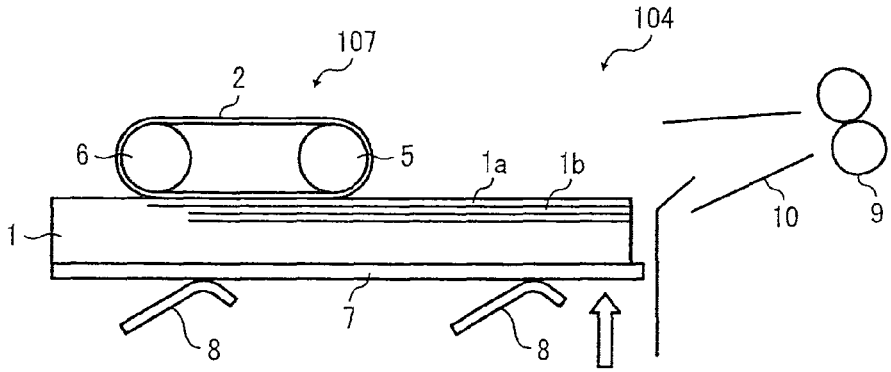
FIGS. 4A to 4C are cross-sectional views illustrating operations of the sheet feeding device according to the embodiment of the present invention.

Subsequently, the operations of the sheet feeding device 104 will be described. As illustrated in FIG. 4A, upon receipt of a sheet feeding command signal from a not-illustrated control unit, the electromagnetic clutch 16 is turned on to drive and rotate the upstream roller 6. Thereby, the belt 2 starts rotating, and is applied with an alternating voltage by the power supply 4 via the roller electrode 3. As a result, the surface of the belt 2 is formed with charge patterns alternating at intervals according to the frequency of the alternating-current power supply and the rotation speed of the belt 2. Preferably, the intervals are set to approximately 4 mm to approximately 16 mm.

After the charging of the belt 2, the bottom plate lifting arms 8 start lifting the lowered bottom plate 7. The bottom plate lifting arms 8 stop lifting the bottom plate 7 when the feeler sensor 18 detects that the uppermost sheet 1*a* of the sheet stack 1 has reached a lift position at which the sheet 1*a* comes into contact with the belt 2 (i.e., the sheet feed position). In the lifting of the bottom plate 7, the lift amount of the bottom plate 7 may be determined on the basis of the calculation of the difference in height between the lower surface of the belt 2 and the position of the upper surface of the sheet 1*a* prior to the lifting of the bottom plate 7, which has previously been detected by the feeler sensor 18.

Figure 4B:
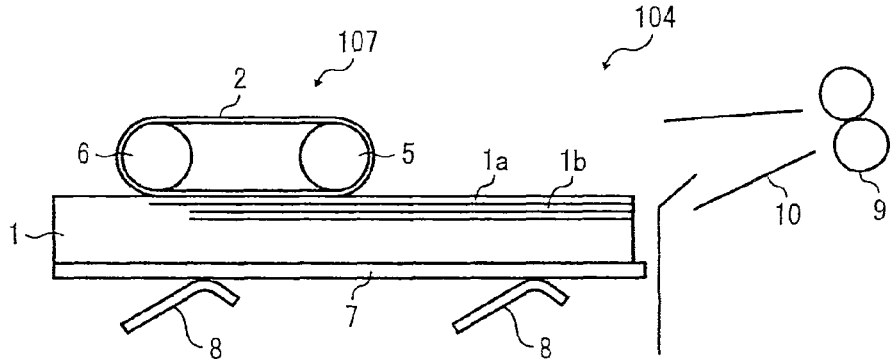

Then, as illustrated in FIG. 4B, in the state in which the belt 2 and the uppermost sheet 1*a* of the sheet stack 1 are in contact with each other, the belt 2 stands by for a predetermined time, which has been preset for each of sheet types. Thereby, the Maxwell stress acts on the uppermost sheet 1*a*, which is a dielectric material, due to a non-uniform electric field generated by the charge patterns formed on the surface of the belt 2. As a result, only the uppermost sheet 1*a* is attracted and held by the belt 2.

Immediately after the contact between the belt 2 and the uppermost sheet 1*a*, the electric field generated by the non-uniform charging of the belt 2 acts on a plurality of sheets of the sheet stack 1 on the basis of the action of the Maxwell stress, and thus attraction force for attracting the plurality of sheets is generated. After the lapse of the predetermines time, however, free electrons in the uppermost sheet 1*a* gather toward the belt 2 to cancel the electric field of the belt 2. Therefore, the attraction force of the belt 2 acts only on the uppermost sheet 1*a*.

Figure 4C:
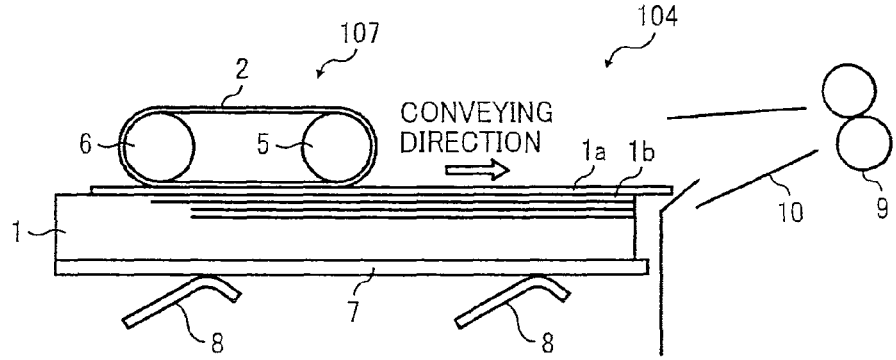

Then, as illustrated in FIG. 4C, the belt 2 rotates and starts conveying the sheet 1*a* in the state in which the sheet stack 1 is kept at the lift position. Then, at a position corresponding to the downstream roller 5, the sheet 1*a* separates from the belt 2 due to the curvature of the downstream roller 5. The conveyance of the sheet 1*a* based on the rotation of the belt 2 does not use the frictional force acting between the belt 2 and the sheet 1*a*, but uses the electrostatic attraction force. It is therefore possible to reduce contact pressure between the belt 2 and the sheet 1*a* to a sufficiently small value. Accordingly, the uppermost sheet 1*a* and the second uppermost sheet 1*b* are prevented from being conveyed together in an overlapped matter due to the frictional force acting therebetween. That is, multiple feeding is prevented. The sheet feeding roller pair 9 and the belt 2 are set to have the same linear velocity. Therefore, if the sheet feeding roller pair 9 is intermittently driven to adjust the timing, the belt 2 is also controlled to be intermittently driven.

Figure 5A:
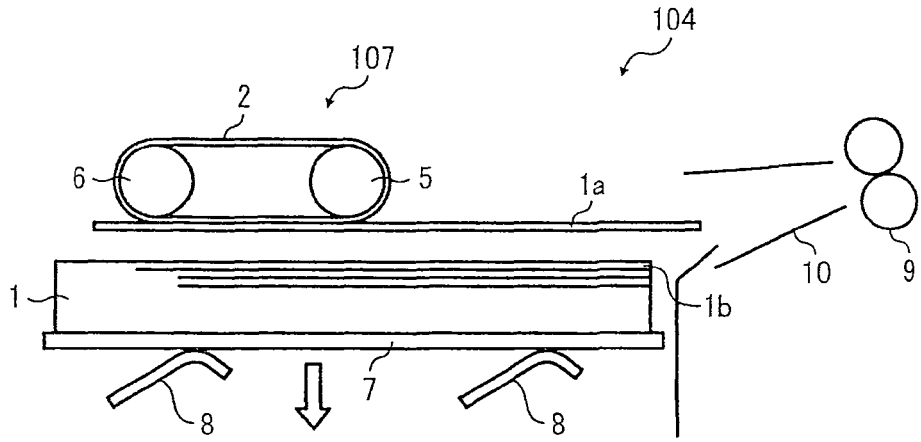
FIGS. 5A and 5B are cross-sectional views illustrating operations subsequent to the operations illustrated in FIGS. 4A to 4C.

Then, as illustrated in FIG. 5A, before the rear end of the sheet 1*a* reaches a position facing the upstream roller 6, the bottom plate 7 is lowered for a predetermined time to separate the belt 2 from the sheet stack 1. Thereby, the second uppermost sheet 1*b* of the sheet stack 1 is prevented from being attracted by the belt 2 during the conveyance of the uppermost sheet 1*a*. Further, in the state in which the belt 2 and the sheet stack 1 are separated from each other, the belt 2 is charged in preparation for the attraction of the next sheet 1*b*.

Figure 5B:
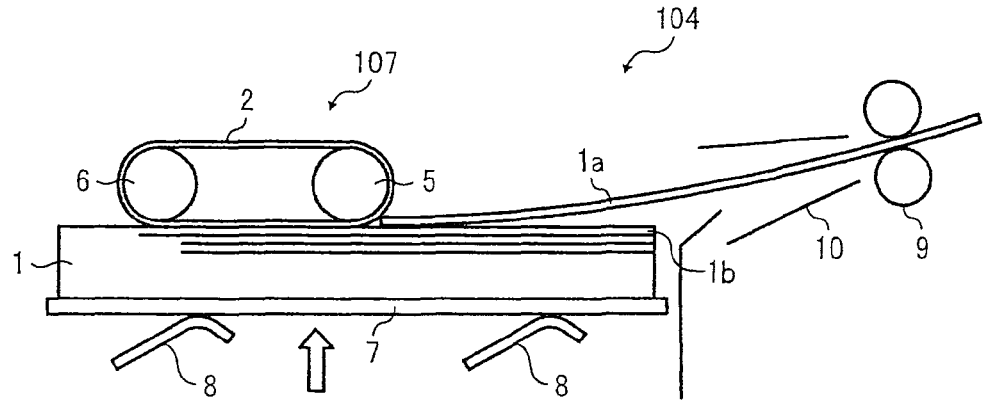

Then, as illustrated in FIG. 5B, the bottom plate 7 is lifted after the rear end of the sheet 1*a* has passed a position facing the downstream roller 5. The sheet stack 1 having the sheet 1*b* on the top thereof is then brought into contact with the belt 2 in a similar manner as in FIG. 4A. The sheet 1*a* separated and conveyed by the belt 2 is conveyed by the sheet feeding roller pair 9 to the image forming unit 103 through the guide plate pair 10.

The power supply 4 is not limited to the alternating-current power supply, and may provide a direct-current voltage alternated between high and low potentials. Further, the waveform of the voltage may be either a rectangular wave or a sine wave. In the present embodiment, the surface of the belt 2 is applied with a rectangular-wave voltage having an amplitude of approximately 4 kV (kilovolts).

If the sheet feeding device 104 includes a discharging roller electrode, the charge of the charged belt 2 can be removed by an alternating voltage applied to the belt 2 by the discharging roller electrode. Specifically, when the outer circumferential surface of the belt 2 is brought into contact with the discharging roller electrode and applied with a direct-current voltage by a direct-current power supply, the belt 2 is not charged by the applied direct-current voltage, if the direct-current voltage does not reach a predetermined voltage. The predetermined voltage is referred to as the charge start voltage. The charge start voltage value $V_0$ varies depending on, for example, the thickness and the volume resistivity of the belt 2.

It has been confirmed that, if the discharging roller electrode is applied with an alternating voltage having the charge start voltage value $V_0$ as the peak value thereof, the surface potential of the charged belt 2 is discharged to substantially 0 V. This indicates that the applied voltage having the charge start voltage value $V_0$ as the peak value thereof is not capable of charging a dielectric object to be charged, but is capable of discharging the object with force for moving the space charge of the object. Further, the applied voltage used here alternates, and thus has the discharging effect whether the dielectric object is positively charged or negatively charged. If the applied voltage does not reach the charge start voltage, however, insufficient discharging is caused. Meanwhile, if the applied voltage exceeds the charge start voltage, charging is caused with an applied frequency of 120 Hz (hertz) and a period (i.e., wavelength=velocity/frequency) of 1 mm, and thus the charge is not discharged to 0 V. It is therefore preferred that the alternating voltage applied to the discharging roller electrode be controlled to have the charge start voltage of the belt 2 as the peak value thereof.

As described above, the sheet feeding device 104 according to the present embodiment includes the bottom plate 7 for carrying thereon the sheet stack 1, the separation unit 107 for electrostatically attracting and separating the uppermost sheet 1*a* from the sheet stack 1 and conveying the separated sheet 1*a*, and the bottom plate lifting arms 8 for lifting and lowering the sheet stack 1 carried on the bottom plate 7. Further, the sheet feeding device 104 causes the bottom plate lifting arms 8 to lift the sheet stack 1 to the lift position at which the uppermost sheet 1*a* comes into contact with the separation unit 107, causes the separation unit 107 to stand by for a predetermined time to attract the uppermost sheet 1*a*, and causes the separation unit 107 to start, after the lapse of the predetermined time, conveying the sheet 1*a* with the sheet stack 1 kept at the lift position. Further, the separation unit 107 is configured to include the downstream roller 5, the upstream roller 6, the endless belt 2 formed by a dielectric material and stretched over the downstream roller 5 and the upstream roller 6, and the elastic member 20 placed inside the belt 2 to bring the belt 2 into contact with the uppermost sheet 1*a*.

With this configuration, the contact surface of the belt 2 with the sheet 1*a* is provided with elasticity. Therefore, even if the surface of the sheet 1*a* has irregularities, has a bump caused by multiple feeding thereof, or has a curled or undulated portion due to a phenomenon such as moisture attraction, it is possible to secure the area of contact between the belt 2 and the sheet 1*a*, and thus to ensure the attraction force for attracting the sheet 1*a* toward the belt 2. Accordingly, the sheet feeding device 104 employing the electrostatic attraction separation method achieves relatively high productivity irrespective of the characteristics of the sheet 1*a*.

Further, in the sheet feeding device 104 according to the present embodiment, the elastic member 20 is divided into the plurality of elastic member pieces 20*a* to 20*f*. With this configuration, the plurality of elastic member pieces 20*a* to 20*f* forming the elastic member 20 are capable of expanding and contracting independently of one another in accordance with respective elastic forces. With the elastic member pieces 20*a* to 20*f* having different amounts of expansion and contraction, therefore, even if the state of the surface of the sheet 1*a* substantially changes due to irregularities or undulations thereof, it is possible to secure the area of contact between the surface of the belt 2 and the sheet 1*a*, and thus to ensure the attraction force for attracting the sheet 1*a* toward the belt 2.

Further, in the sheet feeding device 104 according to the present embodiment, the elastic member 20 is divided into the plurality of elastic member pieces 20*a* to 20*f* in a direction perpendicular to the conveying direction of the sheet 1*a*. With the elastic member 20 divided in a direction perpendicular to the conveying direction of the sheet 1*a*, therefore, there is no change in elastic force in the conveying direction of the sheet 1*a* and thus no burden on the sheet conveying operation. Further, even if the sheet 1*a* is undulated or curled in the direction perpendicular to the sheet conveying direction, the divided elastic member 20 brings the belt 2 into contact with the sheet 1*a*. Accordingly, it is possible to secure the area of contact between the surface of the belt 2 and the sheet 1*a*, and thus to ensure the attraction force for attracting the sheet 1*a* toward the belt 2.

Further, in the sheet feeding device 104 according to the present embodiment, each of the elastic member pieces 20*a* to 20*f* is formed by the contact member 21 which comes into contact with the belt 2 and the spring 22 which biases the contact member 21 toward the belt 2. With each of the elastic member pieces 20*a* to 20*f* formed by the contact member 21 and the spring 22, therefore, it is possible to easily change the elastic force by changing the spring 22, irrespective of the physical properties of the material forming the contact member 21 which comes into contact with the belt 2. Therefore, the elastic force changes for each of the elastic member pieces 20*a* to 20*f*. Accordingly, even if the state of the surface of the sheet 1*a* substantially changes due to irregularities or undulations thereof, it is possible to secure the area of contact between the belt 2 and the sheet 1*a*, and thus to ensure the attraction force for attracting the sheet 1*a* toward the belt 2.

Further, the image forming apparatus 101 according to the present embodiment includes the above-described sheet feeding device 104. Accordingly, the image forming apparatus 101 achieves relatively high productivity irrespective of the characteristics of the sheet 1*a*.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

What is claimed is:

1. A sheet feeding device, comprising:

a sheet carrying unit to carry a sheet stack thereon;

an attraction separation device to electrostatically attract an uppermost sheet of the sheet stack and separate the uppermost sheet from the sheet stack, the attraction separation device including a plurality of rollers;

an endless dielectric belt stretched over the plurality of rollers; and a single elastic member provided inside a loop of the endless dielectric belt and configured to bring the endless dielectric belt into contact with the uppermost sheet, the elastic member being a non-rotatable member;

a sheet conveying device configured to convey the uppermost sheet separated by the attraction separation device; and a lifting and lowering device configured to lift and lower the sheet stack carried on the sheet carrying unit, the lifting and lowering device lifting the sheet stack to a lift position at which the uppermost sheet contacts with the attraction separation device, and the attraction separation device standing by for a set time to attract the uppermost sheet and starting to convey the uppermost sheet after the set time elapses in a state in which the sheet stack remains at the lift position.

2. The sheet feeding device according to claim 1, wherein the elastic member is divided into a plurality of elastic member pieces.

3. The sheet feeding device according to claim 2, wherein the plurality of elastic member pieces are disposed in a direction perpendicular to a conveying direction of the uppermost sheet.

4. The sheet feeding device according to claim 2, wherein each of the elastic member pieces includes a contact member configured to contact the endless dielectric belt and a spring configured to bias the contact member toward the endless dielectric belt.

5. An image forming apparatus comprising a sheet feeding device according to claim 1.

* * * * *